US007498528B2

(12) United States Patent
De France

(10) Patent No.: US 7,498,528 B2
(45) Date of Patent: Mar. 3, 2009

(54) CONDUCTOR CONNECTION

(75) Inventor: Robert V. De France, Poughkeepsie, NY (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/778,960

(22) Filed: Jul. 17, 2007

(65) Prior Publication Data

US 2008/0026600 A1 Jan. 31, 2008

Related U.S. Application Data

(60) Provisional application No. 60/904,080, filed on Feb. 28, 2007, provisional application No. 60/833,642, filed on Jul. 26, 2006.

(51) Int. Cl.
*H01H 9/00* (2006.01)

(52) U.S. Cl. ..... 200/17 R; 174/135; 174/138 R; 439/477; 200/48 R

(58) Field of Classification Search ..... 200/17 R, 200/331, 50.1, 330, 48 R–48 CB; 218/1, 218/12; 294/19.1, 19.3, 24, 26; 337/156, 337/168, 171, 174–176, 194, 202, 203, 208; 439/476.1, 480, 477, 478, 483, 484; 403/109, 403/328, 377–379, 97; 174/138 R, 146, 174/169, 177
See application file for complete search history.

(56) References Cited

U.S. PATENT DOCUMENTS

| | | | | | |
|---|---|---|---|---|---|
| 1,172,604 | A | * | 2/1916 | Johnson, Jr. | 439/477 |
| 1,964,511 | A | * | 6/1934 | Grover | 439/477 |
| 2,096,796 | A | | 10/1937 | Dunaway | 173/273 |
| 2,811,703 | A | | 10/1957 | Becker | 339/264 |
| 2,986,721 | A | * | 5/1961 | Conright | 439/477 |
| 3,065,449 | A | | 11/1962 | Matthysse et al. | 339/247 |
| 3,437,742 | A | | 4/1969 | Lindsey | 174/169 |
| 3,614,700 | A | * | 10/1971 | Beard et al. | 337/203 |
| 3,621,160 | A | | 11/1971 | Turner et al. | 200/48 |
| 3,836,102 | A | * | 9/1974 | Hall | 248/74.4 |
| 4,415,222 | A | | 11/1983 | Polidori | 339/270 R |
| 5,029,797 | A | | 7/1991 | Levorchick et al. | 248/459 |
| 5,397,982 | A | * | 3/1995 | Van Lankvelt | 324/126 |
| 5,423,699 | A | | 6/1995 | Johnson | 439/783 |

(Continued)

OTHER PUBLICATIONS

"Pad Mounted Transformer Secondary Connectors (Z-Bar Shaped)-Lay-in Type", Electric Motion Comapny, 860-379-8515, May 4, 2007, Power Connectors, p. 8 and 10.

(Continued)

*Primary Examiner*—Michael A Friedhofer
(74) *Attorney, Agent, or Firm*—Harrington & Smith, PC

(57) ABSTRACT

Disclosed herein is an electrical connector subassembly. The electrical connector subassembly includes a frame member and a first pad. The frame member includes a first leg section and a conductor receiving area connected to the first leg section. The first leg section is configured to be connected to an electrical isolator. A length of the conductor receiving area extends in a first direction. The conductor receiving area is configured to receive a first electrical conductor in a second direction. The first pad is movably connected to the frame member adjacent to the conductor receiving area. The first pad is configured to contact the first electrical conductor. The first pad is configured to be movable toward the conductor receiving area and the second direction.

34 Claims, 18 Drawing Sheets

U.S. PATENT DOCUMENTS

| | | | | |
|---|---|---|---|---|
| 5,507,671 | A | 4/1996 | Chadbourne et al. | 439/783 |
| 5,539,961 | A | 7/1996 | DeFrance | 24/136 R |
| 5,581,051 | A * | 12/1996 | Hill | 174/138 R |
| 6,282,759 | B1 | 9/2001 | Czaloun | 24/136 R |
| 6,448,503 | B1 * | 9/2002 | Mc Kinnon et al. | 174/146 |
| 6,713,679 | B2 * | 3/2004 | Roberts | 174/135 |
| 2004/0048522 | A1 | 3/2004 | Facey et al. | 439/783 |

OTHER PUBLICATIONS

Aluminum Straight Line Bolted Dead Ends, Pat. No. 4,183,686, Fargo Mfg. Company, Inc., Poughkeepsie, NY, 12603, May 4, 2007.

* cited by examiner

CONDUCTOR CONNECTION

CROSS REFERENCE TO RELATED APPLICATIONS

This application claims priority under 35 U.S.C. §119(e) to U.S. provisional patent application No. 60/833,642 filed Jul. 26, 2006, and U.S. provisional patent application No. 60/904,080 filed Feb. 28, 2007, which are hereby incorporated by reference in their entireties.

BACKGROUND OF THE INVENTION

1. Field of the Invention

The invention relates to a conductor connection and, more particularly, to an in-line switch conductor connection.

2. Brief Description of Prior Developments

In the electrical utilities industry, it is sometimes required to disconnect the current from electrical conductors at electrical distribution poles. This disconnect is most often performed at the pole. However it can be accomplished on the line by utilizing a line disconnect device, which may be an in-line switch for example.

An in-line switch generally comprises two mechanical dead ends with an insulator in between them. U.S. Pat. No. 5,539,961 discloses one configuration of a dead end for use in electrical transmission lines. The conductor is mechanically connected to each dead end and than cut in center between the dead ends. The dead ends may have a knife switch blade mounted/fastened to each dead end. This knife switch blade allows the current to flow from one dead end to the other. The knife switch blade may be permanently fastened to one of the dead ends and may be disconnectable from the other. When one end of the blade is disconnected from the dead end, it stops the flow of the current. Conventional configurations require a lineman/utility worker to support the in-line switch while it is being connected.

Accordingly, there is a need to provide an in-line switch comprising an improved and robust conductor connection which facilitates installation.

SUMMARY OF THE INVENTION

In accordance with one aspect of the invention, an electrical connector subassembly is disclosed. The electrical connector subassembly includes a frame member and a first pad. The frame member includes a first leg section and a conductor receiving area connected to the first leg section. The first leg section is configured to be connected to an electrical isolator. A length of the conductor receiving area extends in a first direction. The conductor receiving area is configured to receive a first electrical conductor in a second direction. The first pad is movably connected to the frame member adjacent to the conductor receiving area. The first pad is configured to contact the first electrical conductor. The first pad is configured to be movable toward the conductor receiving area and the second direction.

In accordance with another aspect of the invention, an electrical connector is disclosed. The electrical connector includes a frame having a first section, a second section, and an electrical isolation section between the first section and the second section. The first section includes a first conductor receiving area and a first pad adjacent to the first conductor receiving area. The conductor receiving area forms a first longitudinal axis. A first end of the first pad is configured to contact a first conductor. A second end of the first pad is rotatably connected to the first section about a pad rotation axis. The pad rotation axis is substantially perpendicular to the first longitudinal axis. The first pad is configured to be rotatable between a first position and a second position. The second section includes a second conductor receiving area.

In accordance with another aspect of the invention, a method of assembling a conductor connector frame member assembly is disclosed. A conductor connector frame member having a first leg section and a conductor receiving area connected to the first leg section is provided. The first leg section is configured to be connected to an electrical isolator. A length of the conductor receiving area extends in a first direction. The conductor receiving area is configured to receive a first electrical conductor in a second direction. A first pad is connected to the conductor connector frame member. The first pad is configured to contact the first electrical conductor. The first pad is configured to be movable toward the conductor receiving area and the second direction.

In accordance with another aspect of the invention, a method of assembling a conductor connector is disclosed. A frame having a first section, a second section, and an electrical isolation section is provided. The first section includes a first conductor receiving area. The first conductor receiving area forms a first longitudinal axis. The second section comprises a second conductor receiving area. The electrical isolation section is between the first and second sections. A first pad is connected to the first connection section. A first end of the first pad is configured to contact the first conductor. A second end of the first pad is rotatably connected to the first section about a pad rotation axis. The pad rotation axis is substantially perpendicular to the first longitudinal axis.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
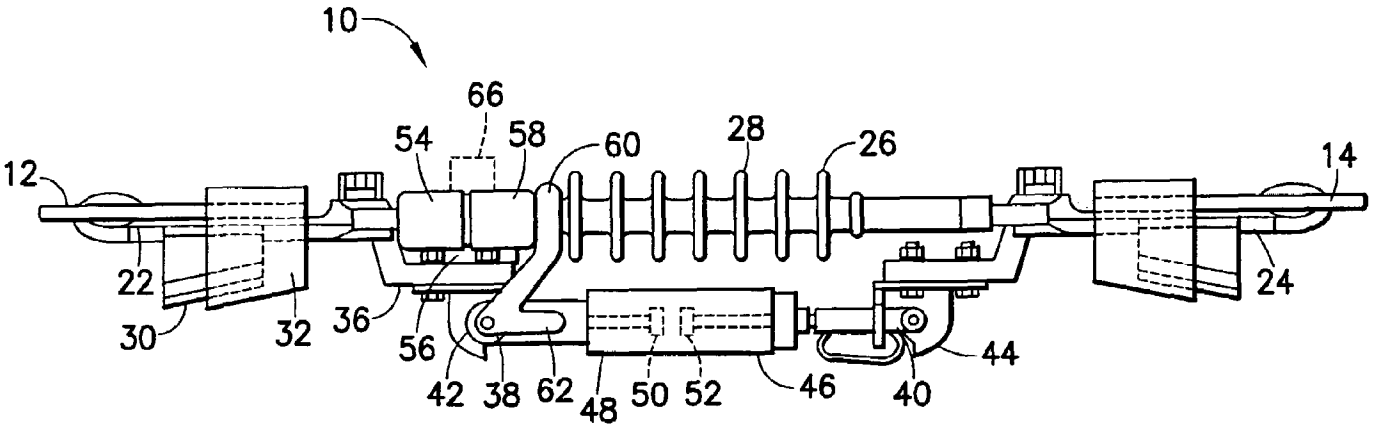
FIG. 1 is an elevational side view of an in-line switch incorporating features of the invention.

Referring to FIG. 1, there is shown an elevational side view of an in-line switch (which may be a vacuum recloser for example) 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The vacuum recloser 10 is shown connecting a first electrical conductor 12 to a second electrical conductor 14. For example, the conductors 12, 14 could be high voltage overhead power distribution lines. However, the vacuum recloser 10 could be used in any suitable application. The vacuum recloser 10 forms a switch between the two conductors 12, 14. When the switch is open, the first and second conductors are not electrically connected to each other through the switch. When the switch is closed, the first and second conductors are electrically connected to each other through the switch. In this embodiment the vacuum recloser is an in-line design connected in-line between the two conductors 12, 14. However, in alternate embodiments, the vacuum recloser could be provided other than in an in-line design.

Figure 2:
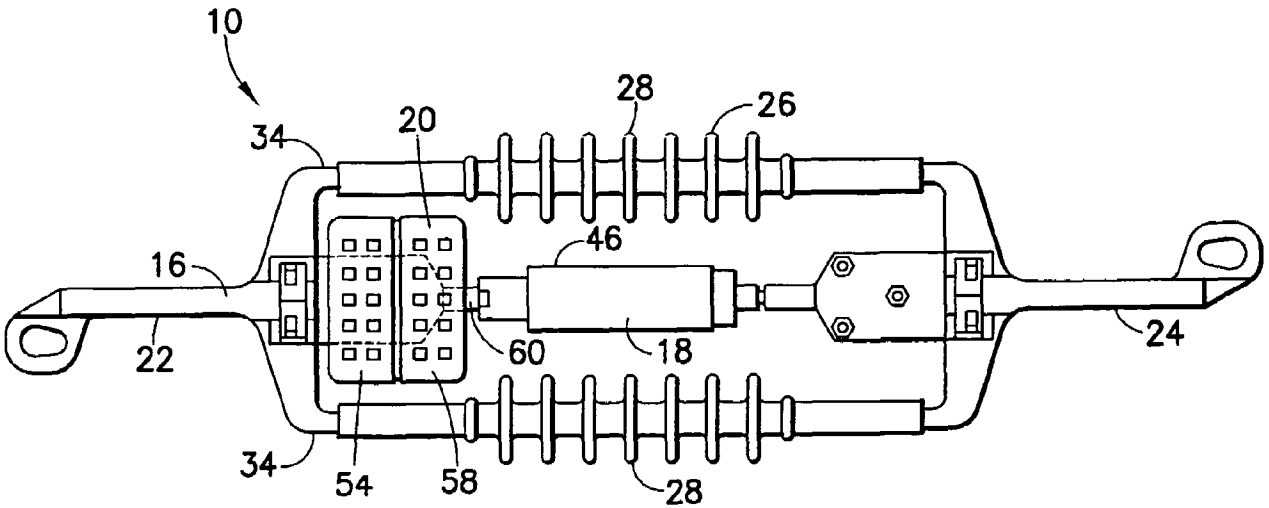
FIG. 2 is a top plan view of the in-line switch shown in FIG. 1.

Referring also to FIG. 2, the vacuum recloser 10 generally comprises a frame 16, an electrical connection section 18, and a control 20. The frame 16 generally comprises a first connection section 22, a second connection section 24, and an electrical isolation section 26. The electrical isolation section 26 structurally connects the first connection section 22 to the second connection section 24. In this embodiment the electrical isolation section 26 comprises two parallel sections 28. Each section 28 has two opposite ends connected to the first and second connection sections, respectively. An open area is formed between the two sections 28. Each section 28 comprises an electrical insulator assembly for electrically insulating the opposite ends of each section 28 from each other and, thus, electrically insulating the first and second sections 22, 24 from each other while still structurally connecting the sections 22, 24 to each other.

In this embodiment, the first and second sections 22, 24 are substantially mirror images of each other. However, in alternate embodiments the two sections 22, 24 could be different. The first connection section 22 is preferably comprised of metal, such as cast metal for example. The first connection section 22 generally comprises an integral wedge section 30 for use with a wedge connector shell 32 for connecting the first connection section 22 with the first conductor. One example of a wedge connector shell is described in U.S. Pat. No. 5,507,671 which is hereby incorporated by reference in its entirety. However, in alternate embodiments, any suitable system for mechanically and electrically connecting the first conductor 12 to the first connection section 22 could be provided. The first connection section 12 comprises two leg sections 34 and a bottom platform section 36. The leg sections 34 are connected to the sections 28 of the electrical isolation section 26. The bottom platform section 36 extends between and beneath the two leg sections. However, in alternate embodiments, the first connection section 22 could comprise any suitable shape. The second connection section 24 is identical to the first connection section; just reversely orientated.

The electrical connection section 18 generally comprises a first end 38 movably connected to the first connection section 22 and an opposite second end 40 movably connected to the second connection section 24. In this embodiment the first end 38 is pivotably connected to the platform section 36 of the first connection section by a pivot connection 42. However, in alternate embodiments, any suitable type of movable connection could be provided. The pivot connection 42 electrically connects the first end 38 to the first connection section 22. The second end 40 is removably connected to the platform section of the second connection section by a latch assembly 44. The latch assembly 44 electrically connects the second end 40 to the second connection section 24. The latch assembly could comprise a primarily friction latch assembly, for example, and could comprise a detent system for preventing unintentional disconnection of the second end 40 from the latch assembly 44.

The electrical connection section 18 forms a movable arm connected between the first and second sections 22, 24. The arm comprises the first and second ends 38, 40 and a vacuum bottle section 46 between the two ends 38, 40. The vacuum bottle section comprises an outer housing 48 and at least two contacts 50, 52 located inside the housing 48. The first contact 50 is adapted to be moved into contact with and out of contact with the second contact 52. The housing 48 could comprise a window to allow a user to view the location of the contacts 50, 52 relative to each other, or the vacuum bottle section 46 could have any other suitable type of visual indicator to signal a user of the open or closed state of the contacts 50, 52. When the contacts 50, 52 are in an open state, the first and second connection sections are not electrically connected to each other. When the contacts 50, 52 are connected to each other in a closed state (with the electrical connection section 18 in the closed configuration shown in FIGS. 1 and 2; contacting the latch assembly 44), the first and second sections 22, 24 are electrically connected to each other.

The control 20 generally comprises three sections; an inductively coupled power supply section 54, a recloser electronic control section 56, and a capacitive discharge and solenoid actuation section 58. These three sections could be mounted on a single printed circuit board as separate modules for example. The inductively coupled power supply section 54 generally comprises a current transformer. Electricity can be inductively generated by the power supply section which is stored by the capacitors and powers the control section 56. The recloser electronic control section 56 generally comprises a voltage monitoring section. The control section 56 can continuously monitor the voltage from the current transformer and, thus, monitor the current being transmitted through the vacuum closer 10 between the two conductors 12, 14. A memory is provided on the printed circuit board which contains pre-installed action criteria. The recloser electronic control section 56 can use this pre-installed action criteria and sensed real time conditions to determine if the contacts 50, 52 of the vacuum bottle section 46 should be opened to stop transmission of current through the vacuum recloser 10.

The capacitive discharge and solenoid actuation section 58 generally comprises capacitors and a solenoid 60. Electricity from the transformer can be stored in the capacitors for use in actuating the solenoid 60 when directed by the recloser electronic control section 56. The solenoid 60 is connected to the first contact 50 of the vacuum bottle section 46 by an armature mechanism 62. When the solenoid relay piston of the solenoid is moved outward, the armature mechanism 62 is adapted to move the first contact 50 out of contact with the second contact 52. Similarly, when the solenoid relay piston of the solenoid is moved inward, the armature mechanism 62 is adapted to move the first contact 50 into contact with the second contact 52. In one type of embodiment the solenoid is a bi-polar solenoid. However, any suitable solenoid could be used. Alternatively, any suitable type of armature drive system could be used.

Figure 3:
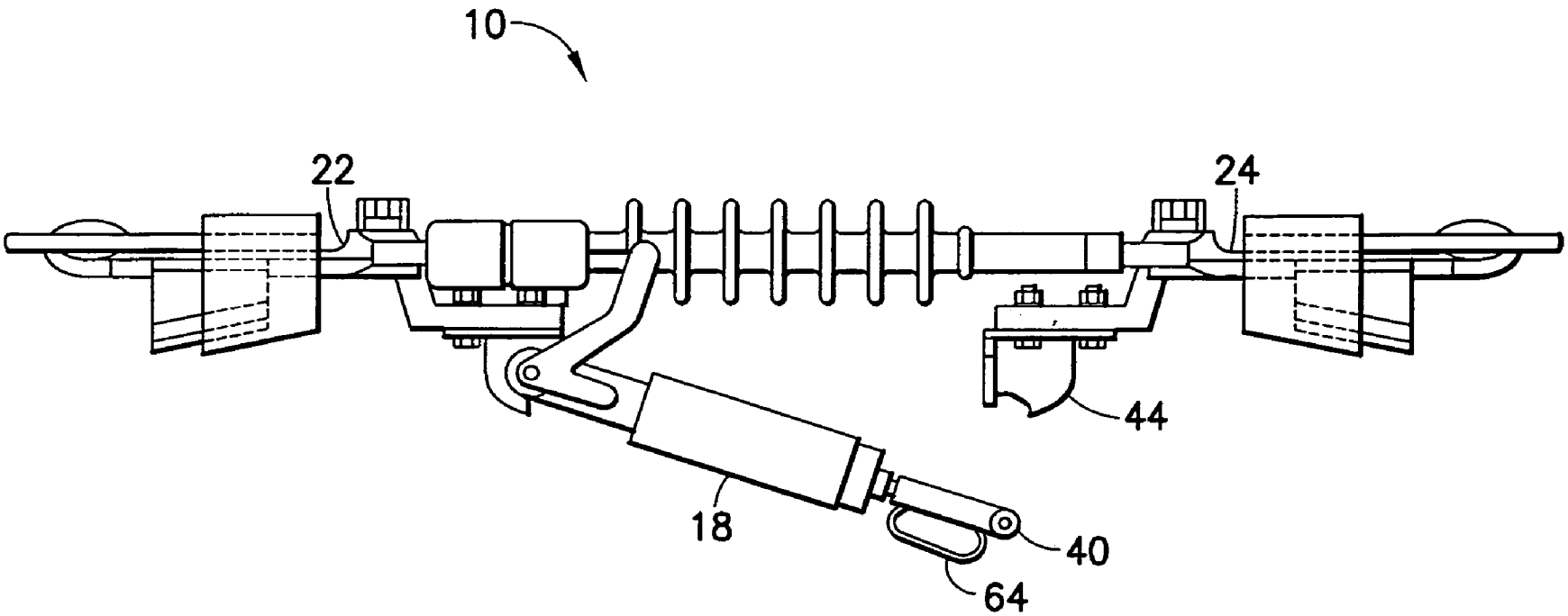
FIG. 3 is an elevational side view of the in-line switch shown in FIG. 1 with an arm of its electrical connection section moved to an open condition.

The control 20, in combination with the armature mechanism 62 and the vacuum bottle section 46 form a first system for opening and closing a path between the first and second connection sections 22, 24. This first system can function automatically based upon real time conditions, such as opening the switch when a voltage overload is occurring. In addition to this first system, the vacuum recloser 10 comprises a second system for opening and closing the path between the first and second connection sections 22, 24. The second system allows a user to manually open and close the path by manually connecting and disconnecting the second end 40 of the vacuum bottle section with the second connection section 24. Referring also to FIG. 3, a further description will be provided.

FIG. 3 shows the vacuum recloser 10 in a manually open state. FIGS. 1 and 3 show the vacuum recloser in a manually closed state. In the manually closed state, the contacts 50, 52 of the vacuum bottle section determine if the switch is opened or closed. In the manually open state, the switch is open regardless of the position of the contacts 50, 52 relative to each other. In the manually open state, the user has moved the second end 40 of the electrical connection section 18 away from connection with the latch assembly 44. This breaks the circuit path through the electrical connection section 18. The second end 40 has a handle 64 for the user to grasp or attach a hot stick to, in order to move the electrical connection section 18 to its open position. When the user is completed performing tasks downstream from the vacuum recloser, the user can then merely return the electrical connection section 18 back to its closed position shown in FIGS. 1 and 2. Cycling of the electrical connection section 18 between its manually open and manually closed positions could also be used to reset the solenoid 60 and armature mechanism back to a home state.

The invention relates to the development of components and devices to modify and improve the application of an in-line switch and will enable it to act as a vacuum recloser. The application of this switch in this fashion eliminates several costly processes and component parts to dramatically reduce production costs while offering similar performance with several additional labor saving and safety related enhancements. Key features include reduced cost, and an ability to unlock a vacuum bottle switch component and swing it down to visually and electrically isolate the downstream circuit for safety reasons. This provided an elimination of a "one shot to lockout" design requirement. The invention is modular so as to allow offering a 1 phase version and a 3 phase version. The present invention reduces the number of additional products typically required and associated with a typical vacuum recloser installation.

The invention could be offered as a switching device product that requires installation with a WEJTAP system, such as with the shells 32. The WEJTAP system is offered by FCI USA, Inc. under the BURNDY line of products. However, in alternate embodiments, any suitable type of connection system for connecting the assembly 10 with the electrical conductors 12, 14 could be provided. The invention could be incorporated into a distribution class (15-35 KVolt) switching device that is installed directly onto an aluminum bare conductor. The switching device can serve as a vacuum recloser, similar to conventional vacuum recliners now commonly used and understood in their traditional, but the invention can comprise a novel feature that it is spliced directly in-line and mid span on the bare overhead conductor and not mounted on any supporting structure as they are now traditionally done. By suspending the switching device mid span, many expensive insulating and heavy mounting components are eliminated reduce its installation cost by 30% or more.

The invention can comprise an in-line switch frame, a vacuum bottle connected between energized sections of the in-line switch frame to serve as the switching medium, a driver circuit consisting of at least one solenoid relay for opening and closing the vacuum bottle mechanism, a voltage/current sensing and control circuit to continuous monitor electrical readings and provide intelligence for energy interruption during predetermined conditions that otherwise could be detrimental to the electrical system and other connected electrical components. The system could also comprise a one-way or a two-way communication circuit 66 (see FIG. 1) to allow communication between multiple components in close proximity, or communication to and/or from a remote central monitoring station. Any suitable communication circuit could be provided, such as a wireless cellular or satellite communications device for example. For example, if the communication circuit 66 allows communication with a remote central monitoring station, the communication circuit 66 could inform the monitoring station when the switch is automatically opened. Additionally, or alternatively, the communication circuit 66 could be used by the monitoring station to remotely trigger changing of the switch in the vacuum bottle section from an open state to a closed state. This might be particularly advantageous for reaching lines which otherwise would be accessed by helicopter. A stored energy circuit could be provided that utilizes Ferro resistant technology to store capacitive energy to power the vacuum bottle switching, the voltage/current sense and control circuit, and the communication circuitry.

The set of contacts 50/52 can open and close to energize and de-energize the circuit while the switch remains in the visual representation shown in FIGS. 1 and 2. With a conventional vacuum recloser, the contacts inside the vacuum bottle cannot be seen visually and there is way by which a person can visually verify a vacuum bottle open or closed contact state; except to trust an indicator mechanism on the solenoid armature mechanism that the contacts are open or closed. The invention, on the other hand as shown by FIG. 3, allows a user to physically disconnect the vacuum bottle from one of the high-voltage transmission lines. Historically, a user has always been very nervous about trusting his or her life to the little armature mechanisms that say the contacts (which are inside the little bottle and cannot seen) are open or closed.

After installation, when the line is energized, the power supply module takes power inductively from the energized circuit and allocates it to the recloser control module and the capacitive module section. The recloser electronic control supplies the intelligence to make open/close decisions. Signals from the current transformer and the voltage monitoring section of the power supply module are fed into the electronic control and are continuously monitored. Its decision to act is based on a comparison of what it is seeing (real-time) on the line with what is stored into its pre-installed memory as action criteria. If a line fault or disturbance occurs, it will be fed real-time to the closure control module. If the sensed real-time conditions meet the criteria required for an opened or closed action, it will instruct one or more of the power capacitors to discharge. The discharging capacitors have the required power to cause the solenoid to open or close causing the solenoid relay piston to move forward or backward. The piston is connected through a mechanism that is, in turn, connected to the vacuum bottle armature. The completed action results in the vacuum bottle contacts being opened or closed rapidly.

Figure 4:
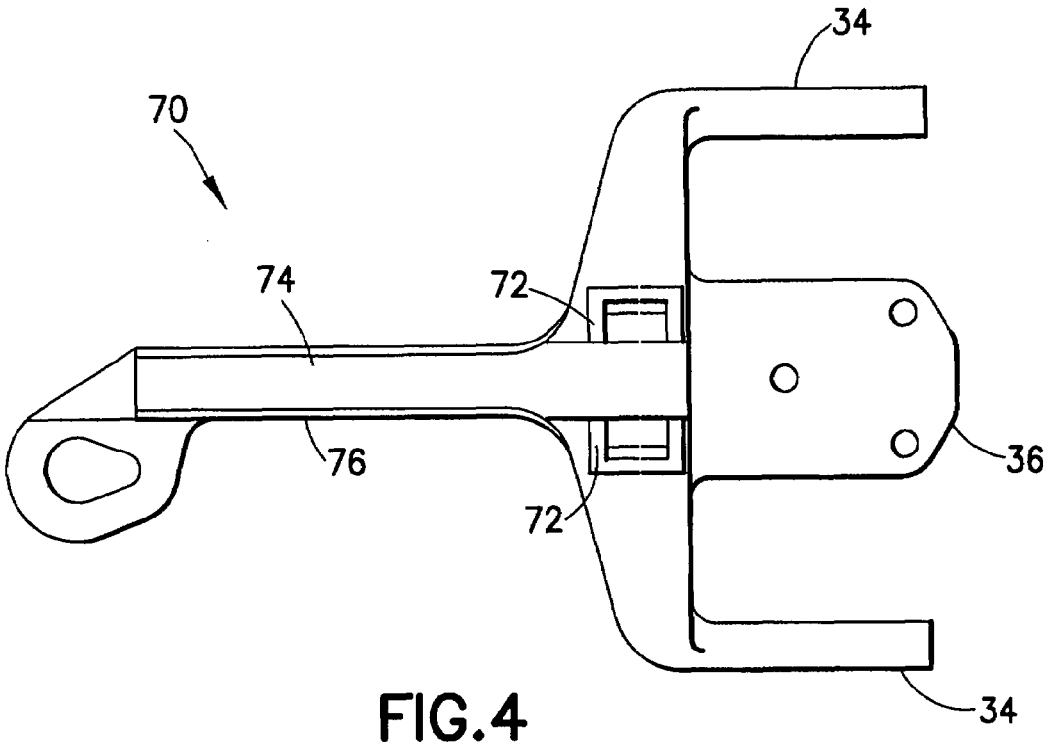
FIG. 4 is a top plan view of a first connection section of the in-line switch shown in FIG. 1.
Figure 5:
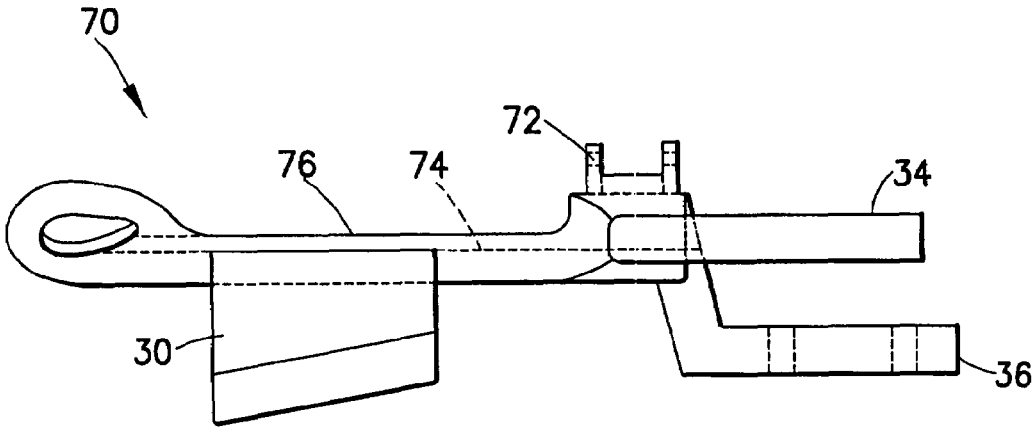
FIG. 5 is a side view of the first connection section of the in-line switch shown in FIG. 1.
Figure 6:
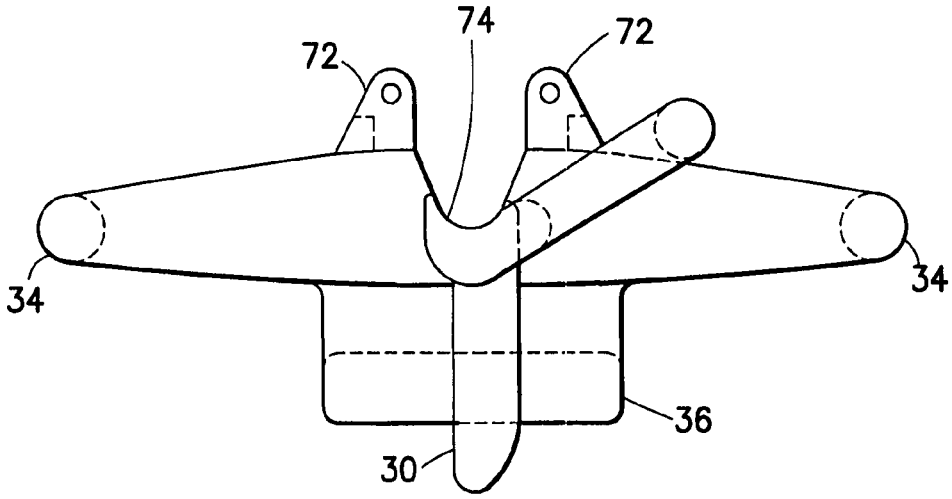
FIG. 6 is a front view of the first connection section of the in-line switch shown in FIG. 1.
Figure 7:
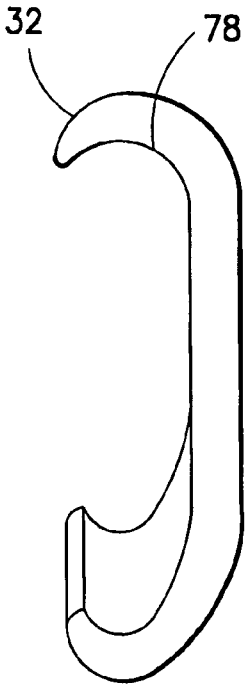
FIG. 7 is a front view of a wedge connector shell of the in-line switch shown in FIG. 1.
Figure 8:
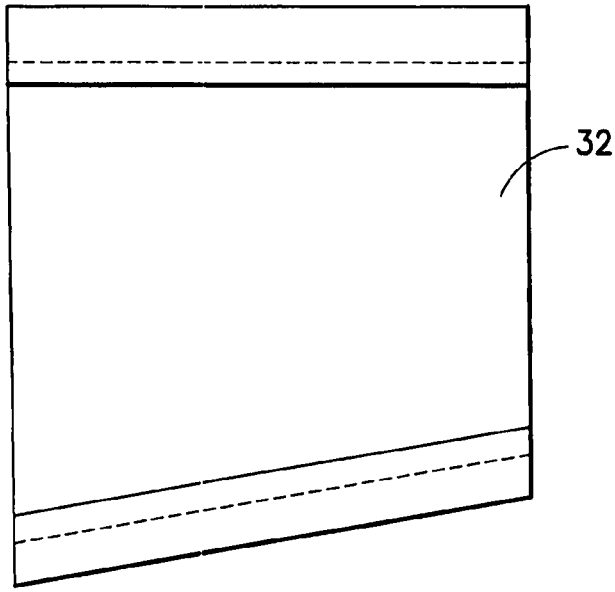
FIG. 8 is a side view of the wedge connector shell of the in-line switch shown in FIG. 1.
Figure 9:
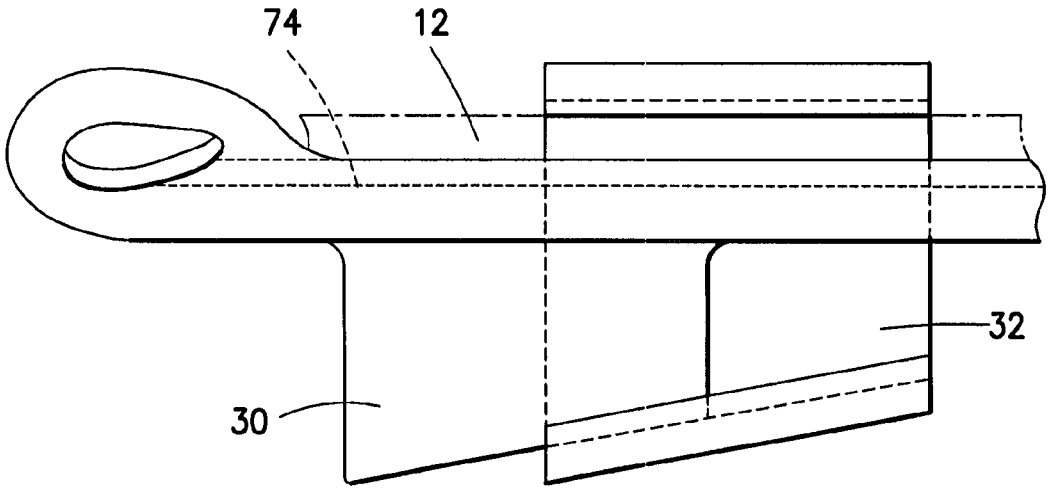
FIG. 9 is an enlarged view of a portion of the first connection section of the in-line switch shown in FIG. 1.
Figure 10:
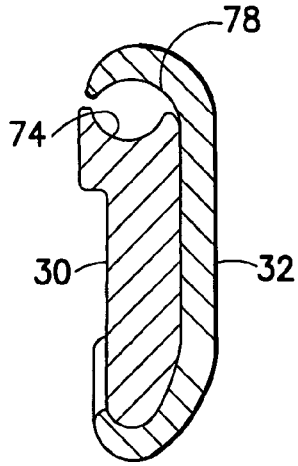
FIG. 10 is a cross section view of the first connection section of the in-line switch shown in FIG. 1 taken at the wedge connector shell.
Figure 13:
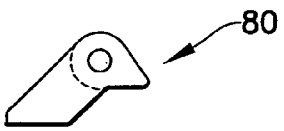
FIG. 13 is a side view of the pad shown in FIG. 11.
Figure 14:
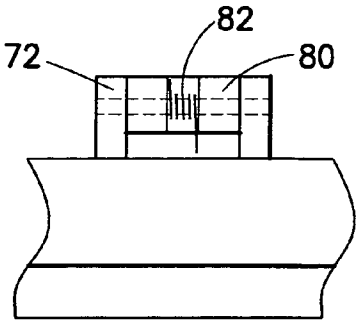
FIG. 14 is a partial view of the first connection section of the in-line switch shown in FIG. 1 illustrating pivot mounting areas and a spring.
Figure 15:
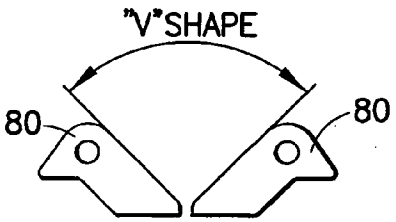
FIG. 15 is a side view of the pads shown in FIG. 11.
Figure 11:
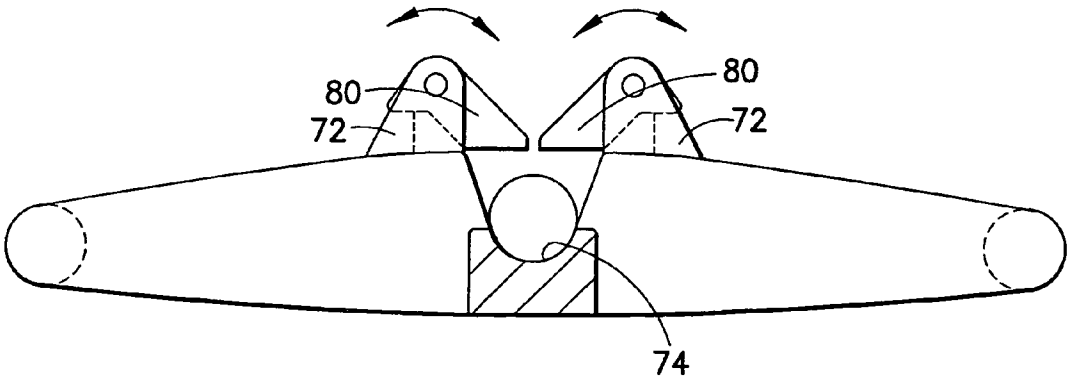
FIG. 11 is a front view of the first connection section of the in-line switch shown in FIG. 1 wherein pads of the section are in a home position.

Referring also to FIGS. 4-6, there is shown a first connection section 22 in accordance with a first embodiment of the present invention. The first connection section 22 preferably comprises a one-piece frame member 70 forming the leg sections 34 and the bottom platform section 36. At a junction of the leg sections 34 and the bottom platform section 36 the frame member 70 comprises two pivot mounting areas 72. A conductor receiving seat, or conductor receiving area, 74 is located between the areas 72 and extends along the length of the mounting section 76. The integral wedge section 30 extends from the bottom side of the mounting section 76. The seat 74 is sized and shaped to receive the conductor 12 therein. The seat or groove 74 forms a longitudinal axis extending along the length of the mounting section 76. FIGS. 7-8 show one example of the conductor shell 32. As seen in FIGS. 9-10, the conductor shell 32 can be mounted onto the integral wedge section 30 to wedge the conductor 12 between the surface 78 of the shell 32 and the seat 74.

Figure 12:
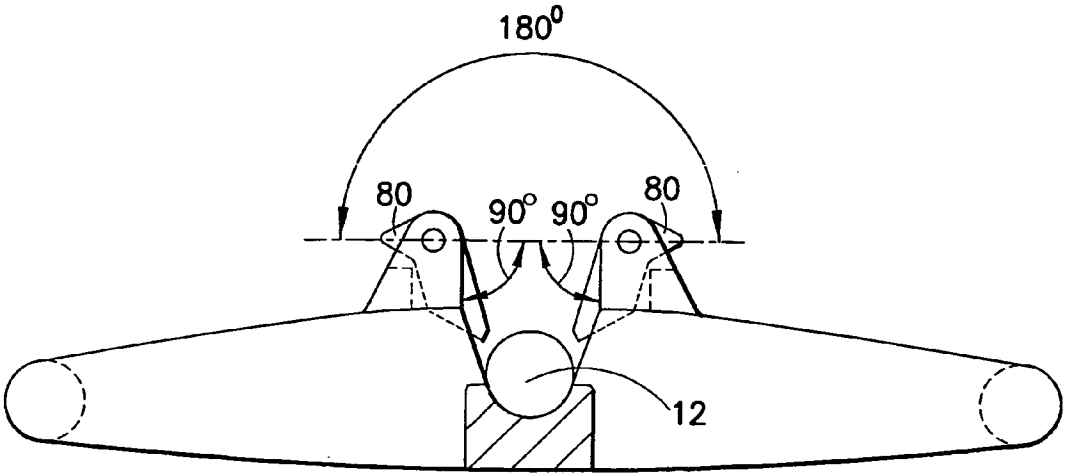
FIG. 12 is a front view of the first connection section of the in-line switch shown in FIG. 1 wherein pads of the section are in a conductor insertion position.

Referring also to FIGS. 11-15, the first connection section 22 also comprises two latches 80. The latches 80 are pivotably mounted to the pivot mounting areas 72. Each latch 80 is preferably spring loaded on the frame member 70 by a spring 82 in an up position shown in FIG. 11. The latches 80 cover a portion of the seat 74, but can be moved out of the way when the conductor 12 is inserted as seen in FIG. 12. In the position shown in FIGS. 11 and 15, the top sides of the latches 80 form a V shape to funnel the conductor 12 into the seat 74. The latches can spring back to their home positions after the conductor 12 is inserted.

In the electrical utilities industry it is sometimes required to disconnect the current. This disconnect is most often done at the pole. However it can be accomplished on the line. In order to make a line disconnect, a device called an in-line switch, is used. The in-line switch consists of two mechanical dead ends with an insulator in between them.

The conductor is mechanically connected to each dead end and than cut in the center between the dead ends. The dead ends have a knife switch blade mounted that is fastened to each dead end. This knife switch blade allows the current to flow from one dead end to the other. The knife switch blade is permanently fastened to one of the dead ends and is disconnectable from the other. When the one end of the blade is disconnected from the dead end it stops the flow of the current.

The embodiment of the dead end consists of a pre-installation design for hanging it on the conductor. The pre-installation hanging design, consist of two pads or latches 80 that are spring loaded (or biased). The pads are mounted 180 degrees apart. The pad has a pivoting point that allows it to rotate approximately 90 degrees. The pivoting point is located at the top of the pad and is offset to one side. The pad has a surface that is tapered downward and away from the pivoting point. When the two pads are assembled into the cavity of the body the tapered surfaces form a 'V' shape and act as a guiding area for the conductor to enter into the body 70.

The opposite area of the taper portion of the pad has a notch. The one side of the notch is the leg which the spring makes contact with, and other side prevents the pad from rotating in the cavity of the body 70. The pad has a relief area (notch) along the length of the pivoting axis's. This notch is for the spring to be inserted into. One end of the spring makes contact with the back side of the pad and the other end makes contact with the cavity surface. The cavity is part of the dead end body 70. The cavity has a notch and, on each side of this notch, there are perturbing legs. The two legs have a hole in each one; that is the pivoting point for the pad. The pad is installed between the two legs and a pin is installed thru the legs and pad.

The in-line switch can be easily installed on to the conductor. The spring loaded pads 80 on each of the dead ends allows the in-line switch to be installed onto the conductor with very little effort. The conductor is inserted thru the middle of the two pads (in a direction generally perpendicular to the length of the mounting section 76) and, because of the limited rotation of the pads, they do not allow the conductor to exit. This keeps the in-line switch or connector attached to the conductor or conduit so that the lineman's hands can be freed during installation.

Figure 16:
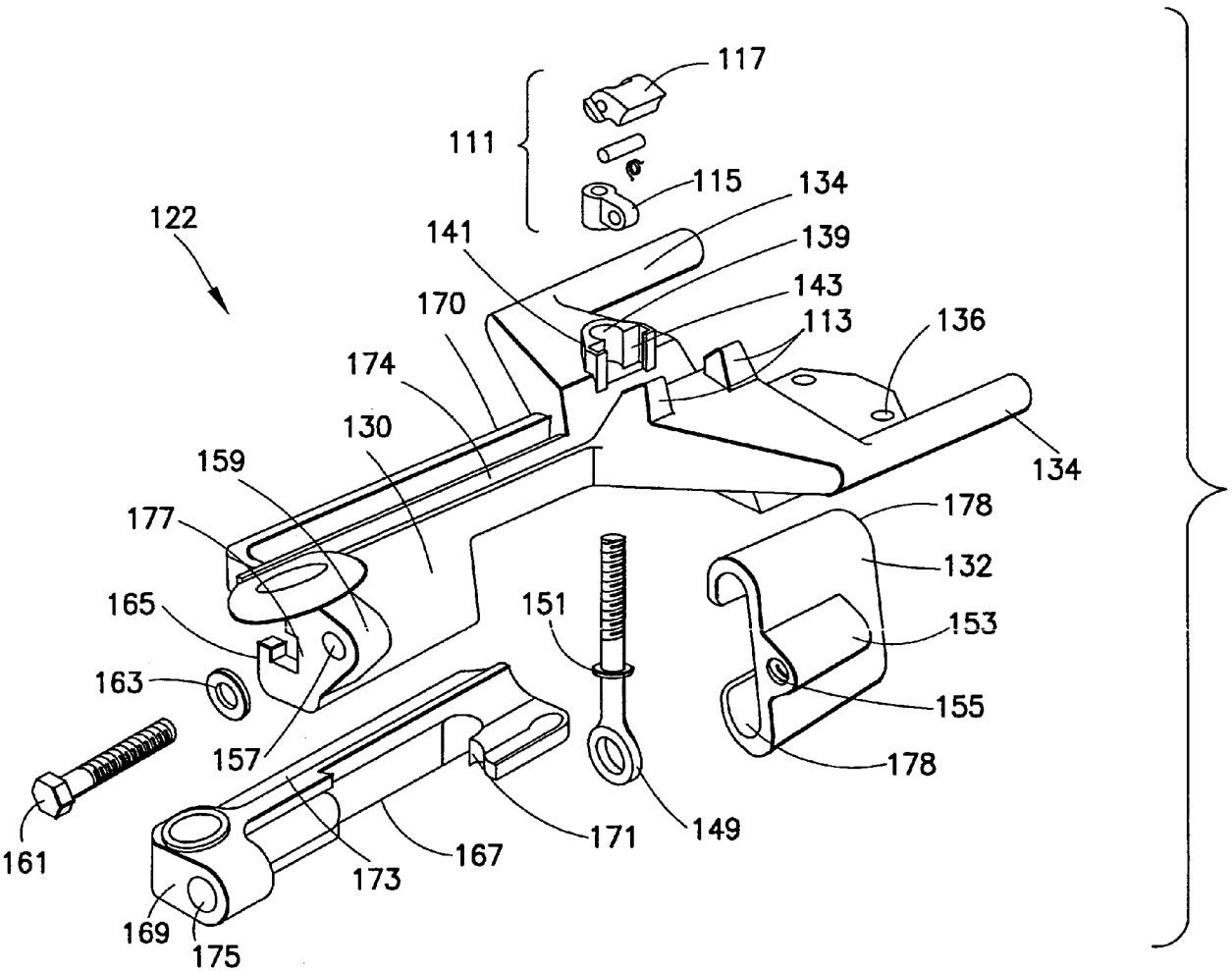
FIG. 16 is an exploded perspective view of a first connection section in accordance with a second embodiment of the invention.

Referring now to FIG. 16, there is shown an exploded perspective view of a first connection section 122 comprising a one-piece frame member 170 in accordance with a second embodiment of the present invention. The first connection section 122 and the one-piece frame member 170 are similar to the first connection section 22 and the one-piece frame member 70 of the first embodiment and similar features are similarly numbered.

Figure 17:
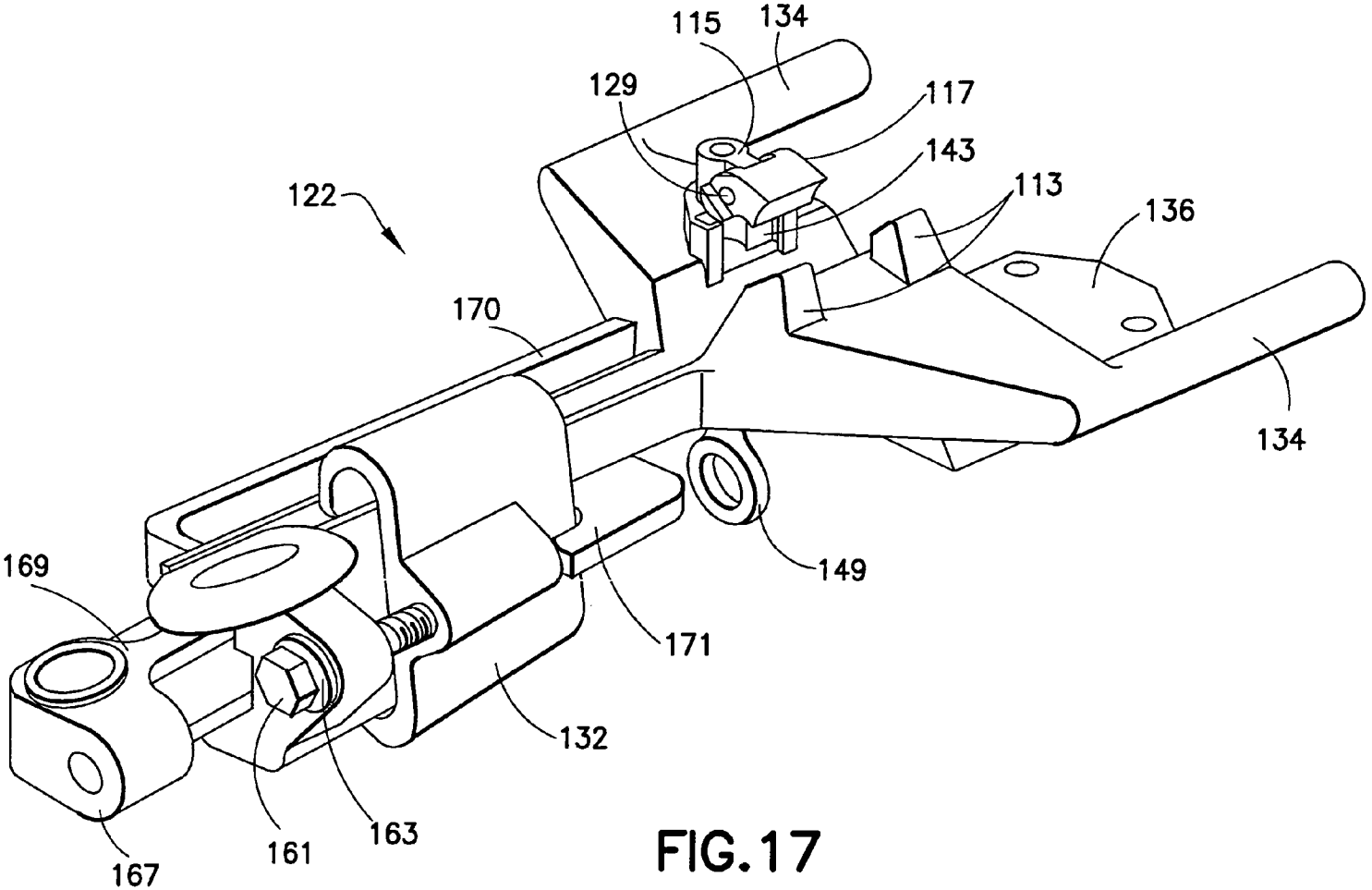
FIG. 17 is perspective view of the first connection section shown in FIG. 16.
Figure 18:
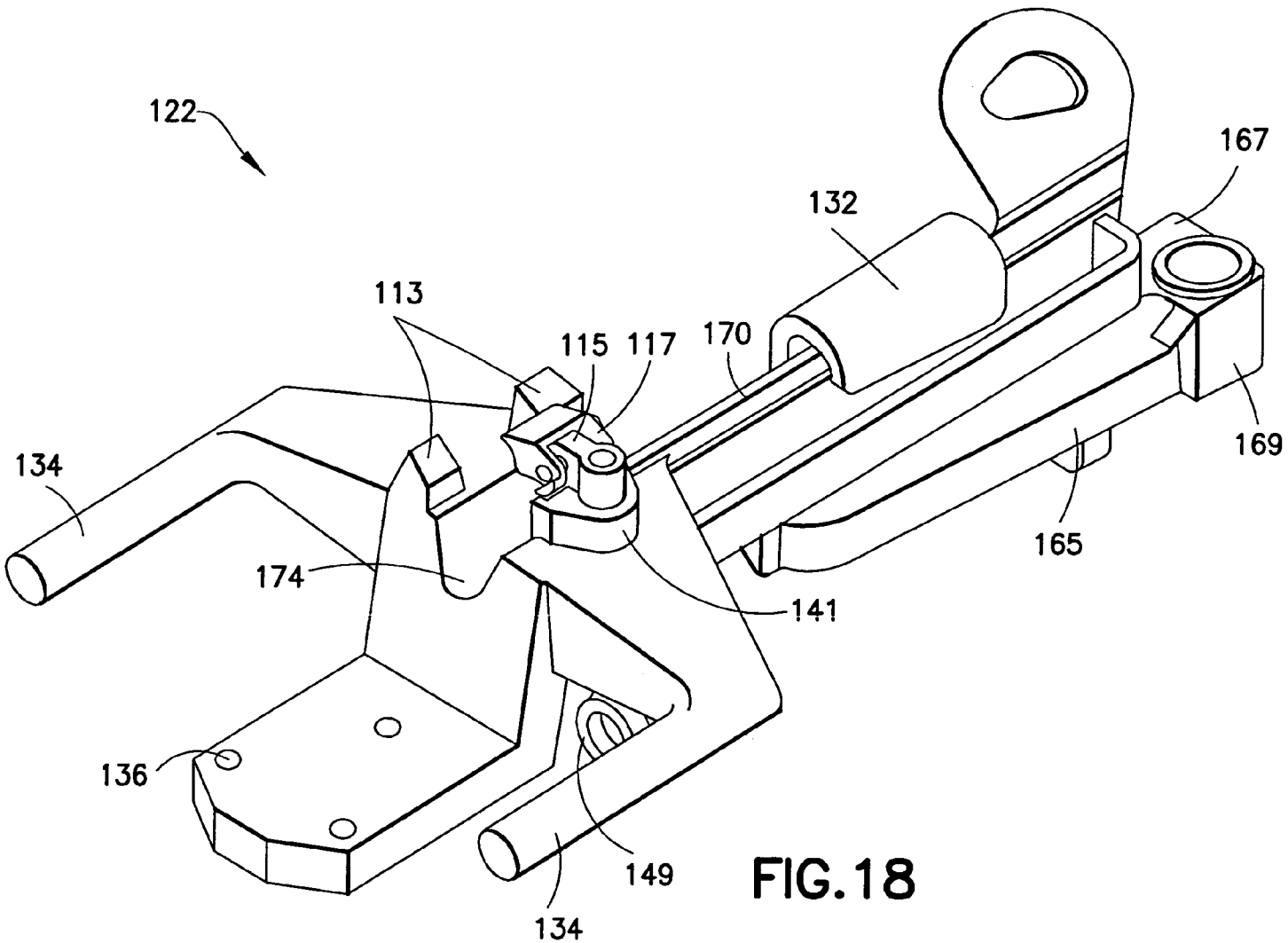
FIG. 18 is perspective view of the first connection section shown in FIG. 16.

Referring also to FIGS. 17 and 18, the one-piece frame member 170 comprises leg sections 134, a bottom platform section 136, a conductor receiving seat or groove 174, and an integral wedge 130 as described above for the first embodiment.

One difference between the first connection section 122 and the first connection section 22 is that the first connection section 122 does not comprise the two latches 80. Instead, the first connection section 122 comprises a two-piece pad assembly 111 and conductor guide rails 113.

Figure 19:
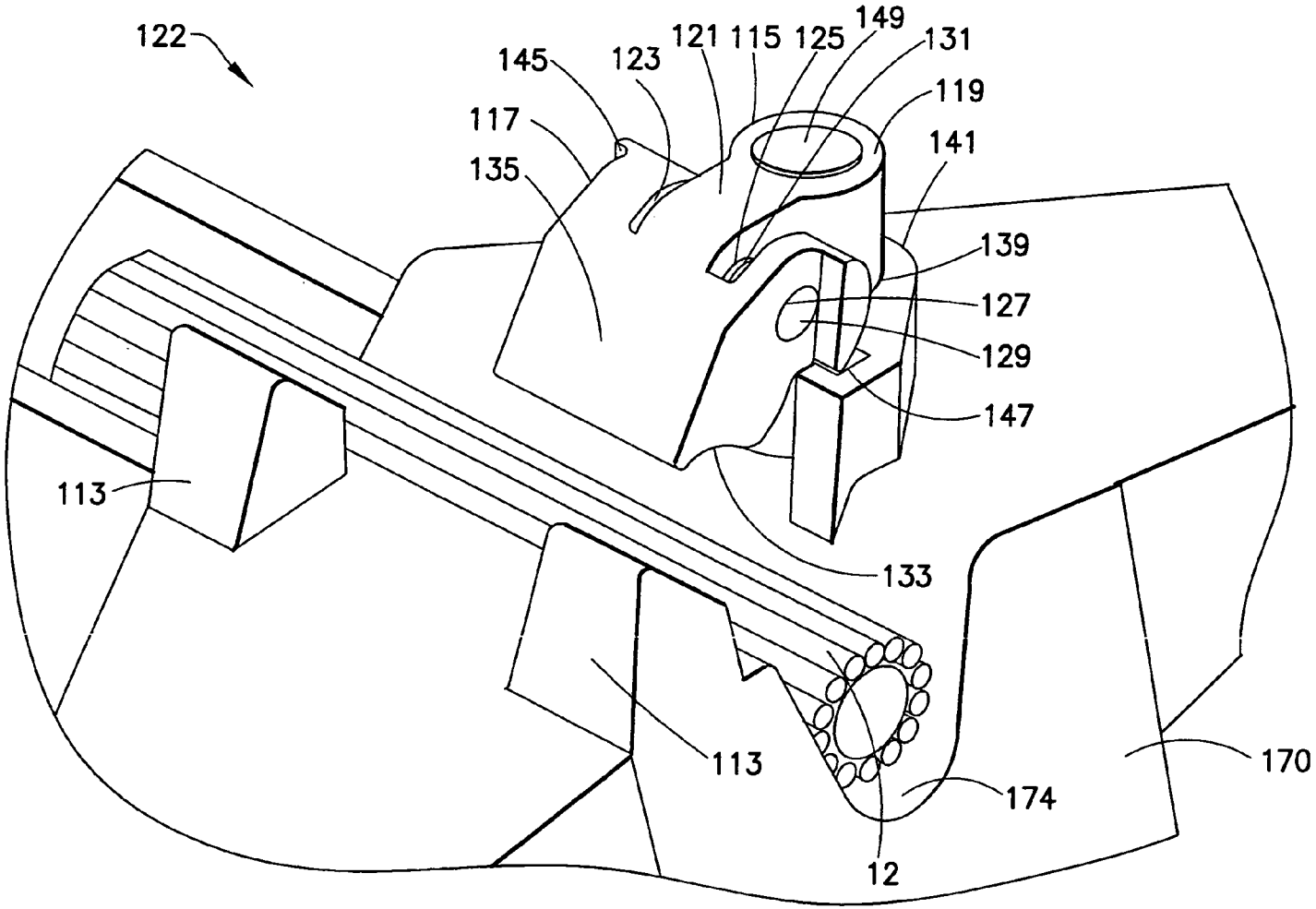
FIG. 19 is an enlarged perspective view of a portion of the first connection section shown in FIG. 16.
Figure 20:
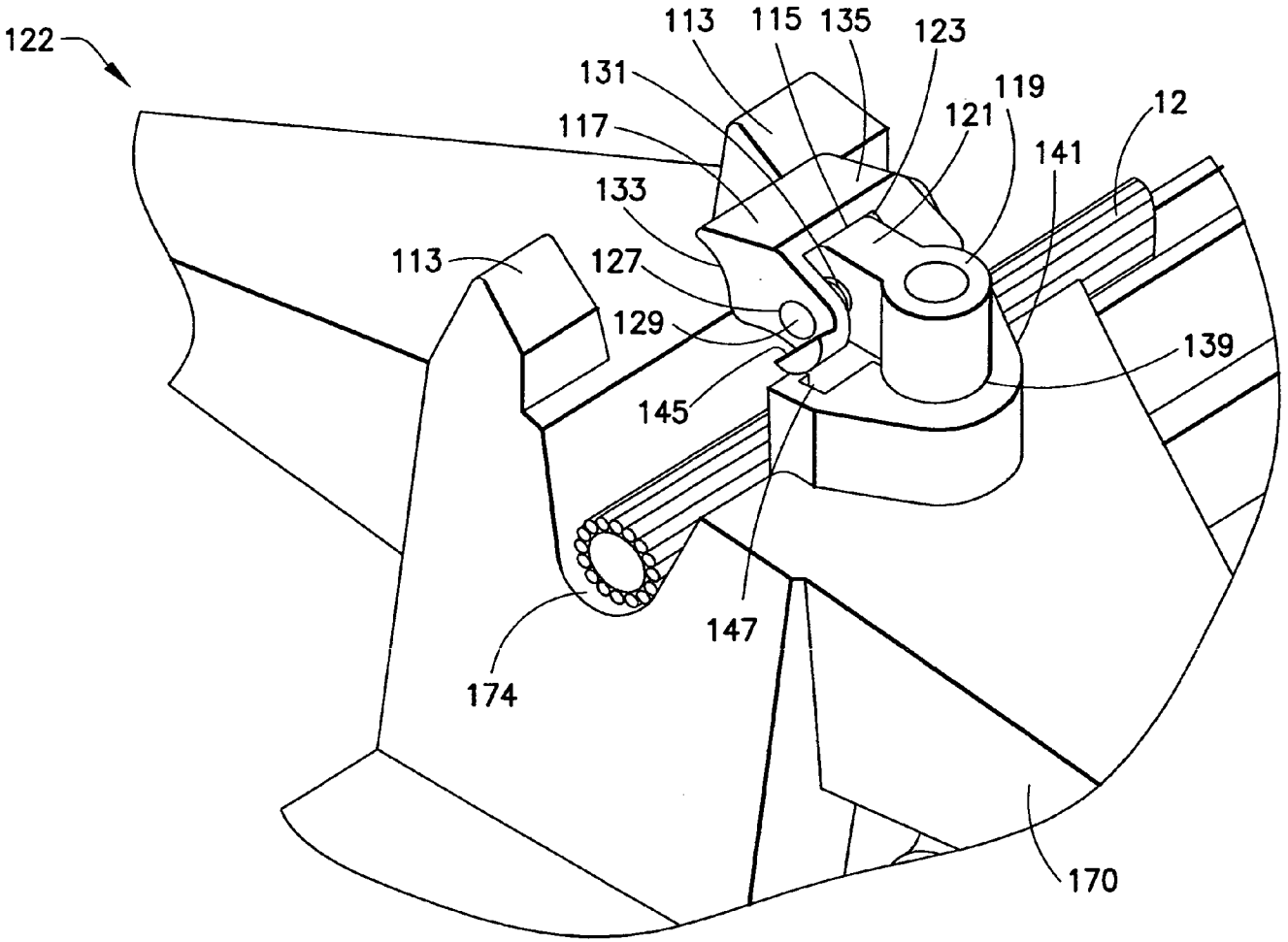
FIG. 20 is an enlarged perspective view of a portion of the first connection section shown in FIG. 16.

Further illustrated in FIGS. 19-20, the two-piece pad assembly 111 comprises an arm/pad member 115 and a swivel pad 117. The arm/pad member (or arm member) 115 comprises a main body portion 119 and an extending arm portion 121. The extending arm portion 121 is suitably sized and shaped to fit within a slot 123 of the swivel pad 117. When the extending arm portion 121 is disposed within the slot 123, an opening 125 in the extending arm portion is aligned with openings 127 in the swivel pad 117 to allow for a pin 129 to be fitted within the openings 125, 127. The pin 129 rotatably attaches the swivel pad 117 to the arm/pad member 115. Additionally, a spring 131 may be fitted around the pin 129 and between the swivel pad 117 and the arm/pad member 115.

The swivel pad 117 also comprises a conductor contact surface 133 and a conductor guide surface 135. The conductor guide surface 135, along with the conductor guide rails 113, act as lead in features which facilitate insertion of the conductor 12 into the groove 174. It should be understood that although the figures illustrate two conductor guide rails 113, any number of conductor guide rails 113 may be provided.

The arm/pad member 115 fits within a pad cavity 139 of the one-piece frame member 170. It should be noted that the pad cavity 139 may be a cavity within a raised pad or boss 141 as illustrated in the figures. However, the cavity 139 may be disposed within any suitable portion of the one-piece frame member 170 or the raised boss 141 may be a separate component bolted on to the frame member 170 for example. The cavity 139 comprises a suitable shape for receiving the arm/pad member 115. The pad cavity 139 also comprises an open side 143, facing the conductor groove 174, which allows for the extending arm portion 121 to extend therethrough.

The two-piece pad assembly 111 is fitted within the pad cavity 139 in order to clamp and secure the conductor 12 to the first connection section 122. The pad assembly 111 travels in a vertical position or direction inside of the cavity 139. The cavity 139 may have a generally cylindrical shape for example. The cavity 139 is also preferably oriented to be substantially perpendicular to the conductor groove 174. Therefore the vertical position or direction generally refers to a pad assembly 111 insertion direction (into the cavity 139) as shown in the figures.

When the pad assembly 111 is partially in the cavity 139 (as shown in FIG. 19) the swivel pad 117 rotates in the downward direction toward the conductor groove 174. This allows the conductor 12 to pass by the swivel pad 117 and enter the groove 174 thus preventing the conductor 12 from exiting the groove 174. After the conductor 12 is fitted within the groove 174, the pad assembly 111 is lowered into the cavity 139 towards the conductor 12. Additionally, the swivel pad 117 may comprise pad guide rails (or guide tabs) 145 at opposite ends of the swivel pad 117 which are received by guide rail slots (or guide tab slots) 147 within the cavity 139. The guide rails 145 and guide rail slots 147 secure the swivel pad 117 by preventing rotation of the swivel pad 117 and maintaining contact with the conductor 12.

A threaded eyebolt 149 is inserted into the cavity 139 from a bottom side (opposite the side comprising the conductor groove 174) of the one-piece frame member 170 to secure the pad assembly 111 within the cavity 139. Although a threaded eyebolt 149 is shown in the figures, it should be noted that any suitable fastening feature between the eyebolt 149 and pad assembly 111 may be provided. The eyebolt 149 may further comprise a flange 151 to serve as a stop feature against the bottom side of the one-piece frame member 170. When the pad assembly 111 exits the cavity 139 only then can the conductor 12 exit the conductor groove 174. This occurs because the swivel pad 117 is allowed to rotate upward (as shown in FIG. 20) and away from the conductor groove 174.

Figure 21:
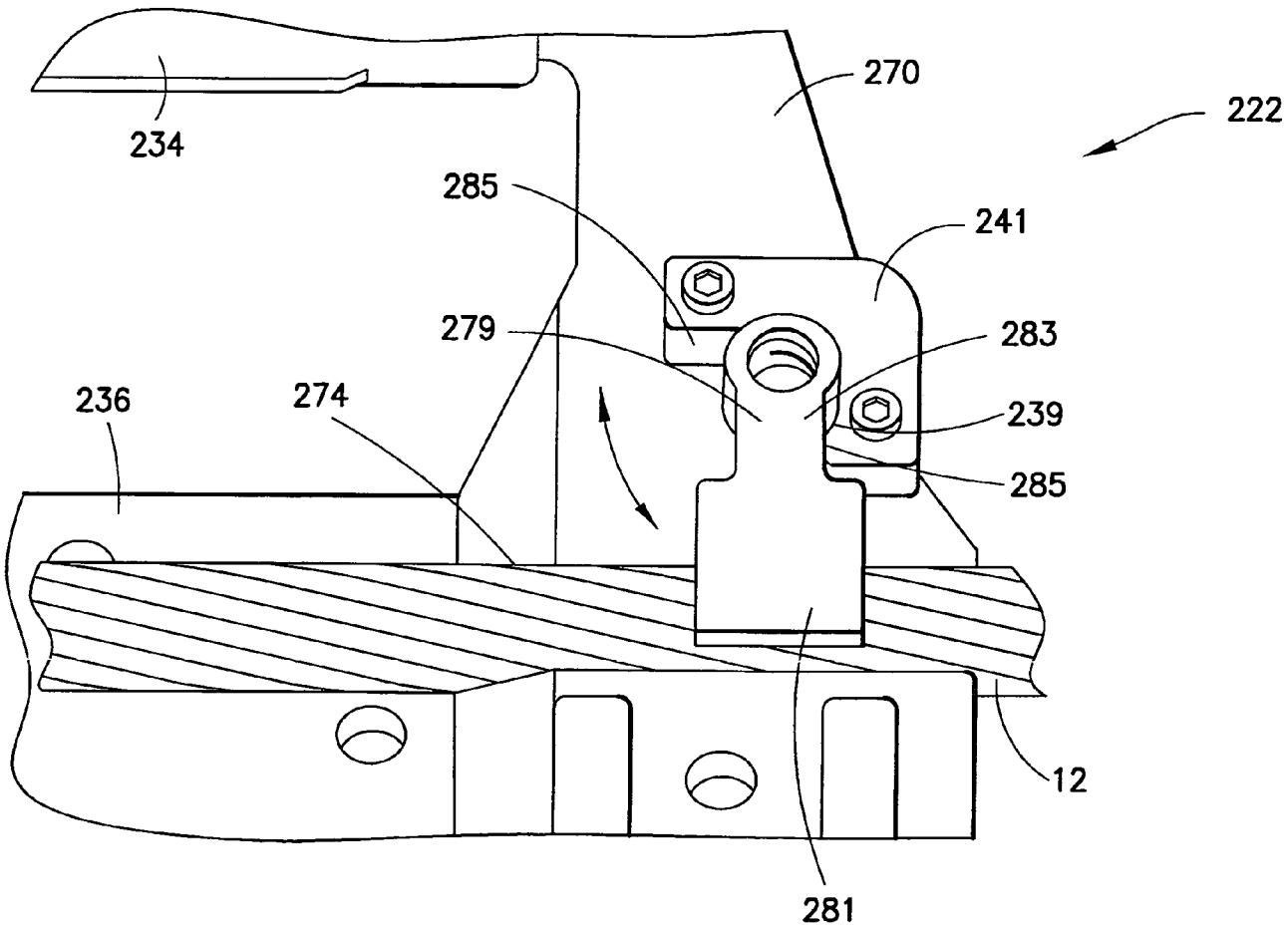
FIG. 21 is a partial perspective view of a first connection section in accordance with a third embodiment of the invention.

Referring now to FIG. 21, there is shown a perspective view of a portion of a first connection section 222 comprising a one-piece frame member 270 in accordance with a third embodiment of the present invention. The first connection section 222 and the one-piece frame member 270 are similar to the first connection section 22 and the one-piece frame member 70 of the first embodiment and similar features are similarly numbered.

Figure 22:
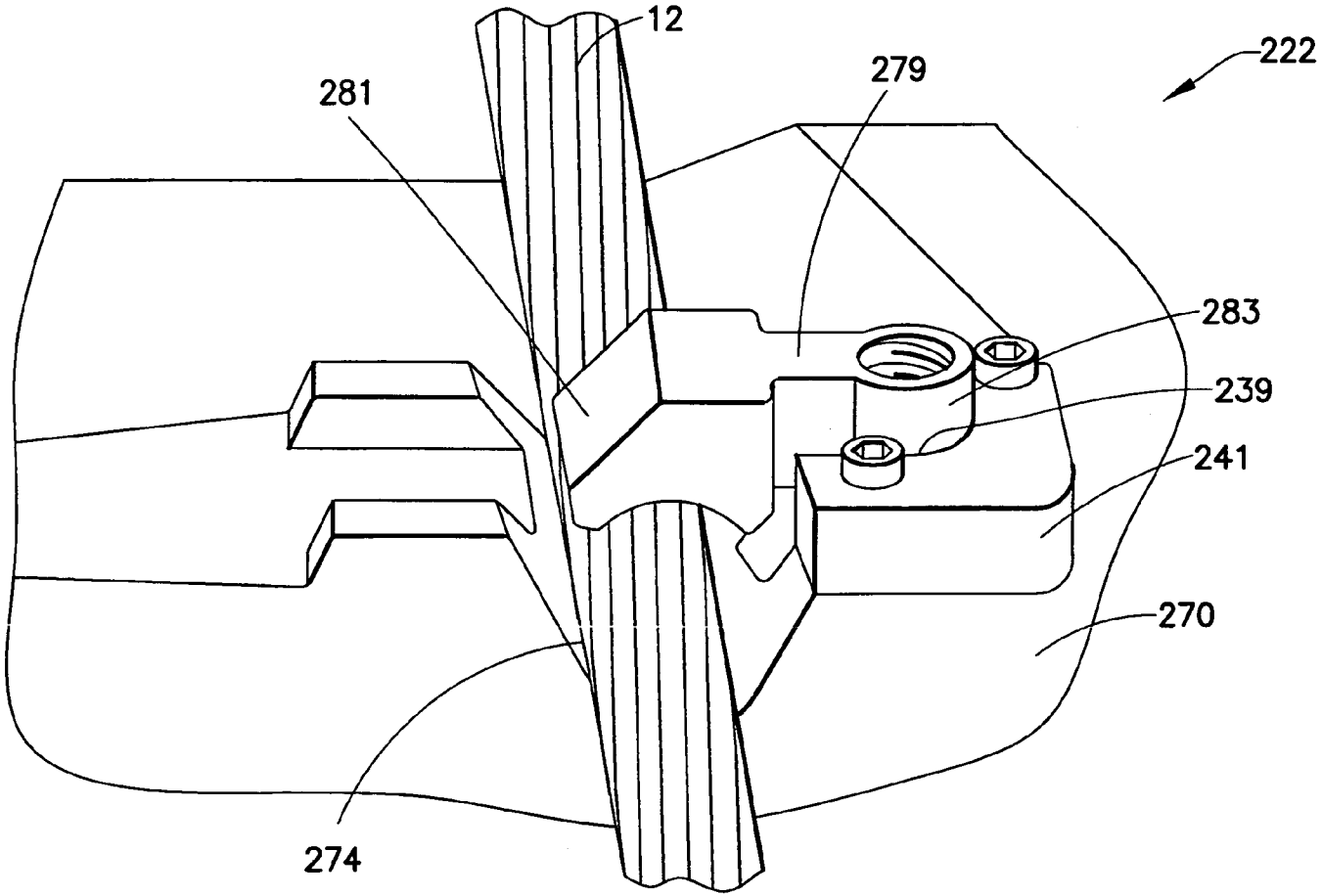
FIG. 22 is a partial perspective view of the first connection section shown in FIG. 21.
Figure 23:
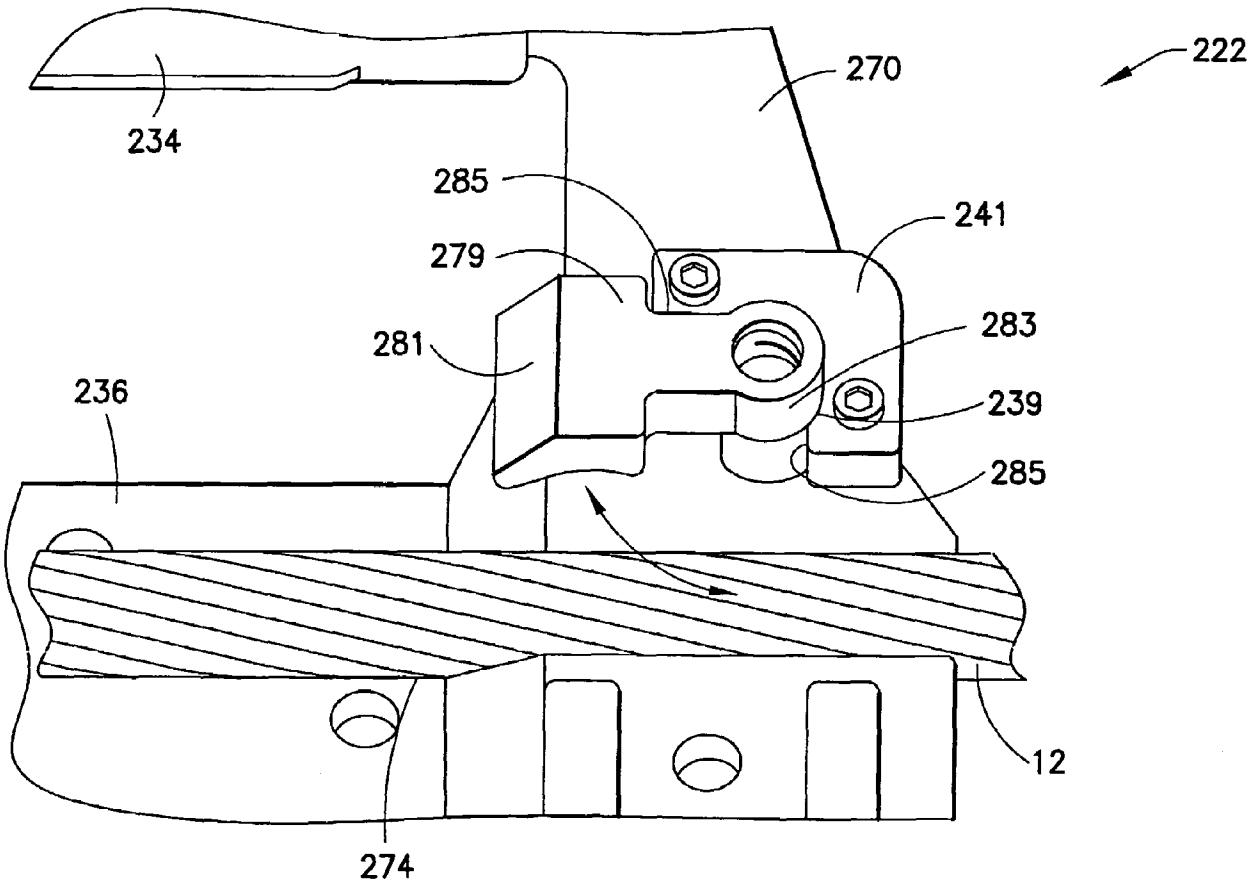
FIG. 23 is a partial perspective view of the first connection section shown in FIG. 21.

Referring also to FIGS. 22 and 23, the one-piece frame member 270 comprises leg sections 234, a bottom platform section 236, a conductor receiving seat or groove 274, and an integral wedge (not shown) as described above for the first embodiment.

One difference between the first connection section 222 and the first connection section 22 is that the first connection section 222 does not comprise the two latches 80. Instead, the first connection section 122 comprises a one piece pad 279.

Figure 24:
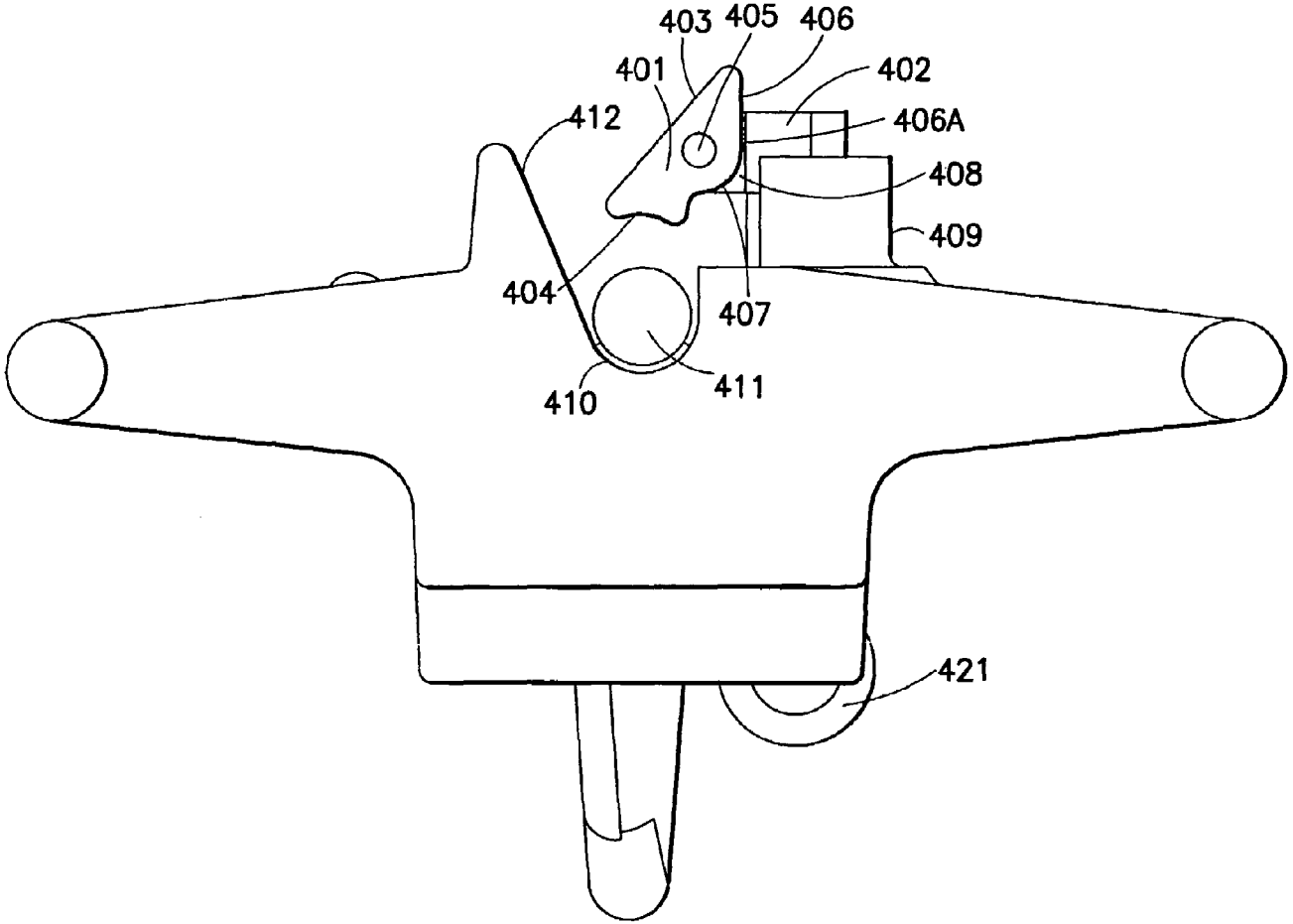
FIG. 24 is a front view of a first connection section in accordance with a fourth embodiment of the invention.

The one piece pad 279 comprises a first end 281 and a second end 283. The first end 281 is configured to contact the conductor 12. The second end 283 is configured to have a suitable shape allowing for rotation of the pad 279 about a cavity 239. The design allows the pad 279 to rotate in two directions clockwise and counter clockwise at about ninety degrees. The pad 279 rotates about an axis that is substantially perpendicular to the longitudinal axis of the groove 274. The cavity 239 may be an opening within a pad or boss 241 fastened to the one-piece frame member 270 as illustrated in FIGS. 22-24. However, it should be understood that the raised pad or boss 241 may be integral with the one-piece frame member 270. Or alternatively, there may be no raised pad or boss 241 at all and instead a suitably shaped cavity within the one-piece frame member 270 may be provided. The cavity 239 in the body or boss 241 consists of a cylindrical hole with two protruding stops 285 about ninety degrees apart at the opening of the cavity 239. Additionally, although the figures illustrate the cavity 239 and the second end 283 of the pad 279 as being cylindrically shaped, any suitable shape allowing for rotation may be provided.

The boss 241 is also configured to allow the pad 279 to travel in a vertical position or direction (parallel to the cavity 239 centerline) inside of the cavity 239 as well as rotation about the cavity 239 centerline. When the pad 279 is in the upward position (as shown in FIG. 23) the boss 241 is configured to allow the pad 279 to rotate in a clockwise direction (about ninety degrees) to an open position. In the open position, the conductor 12 can then be installed into the conductor groove 274. When the pad 279 is rotated in a counter clockwise direction (about ninety degrees), the conductor 12 cannot exit the conductor groove 274. When the pad 279 is in the full counter clockwise position, the pad 279 may then be clamped on to the conductor 12. It should be noted that although the figures illustrate a pad rotation of about ninety degrees, pad rotations less than or greater than ninety degrees are also envisioned. Additionally, the pad 279 may be secured within the cavity 239 by any suitable fastening means, such as the threaded eyebolt configuration of the second embodiment for example.

Figure 25:
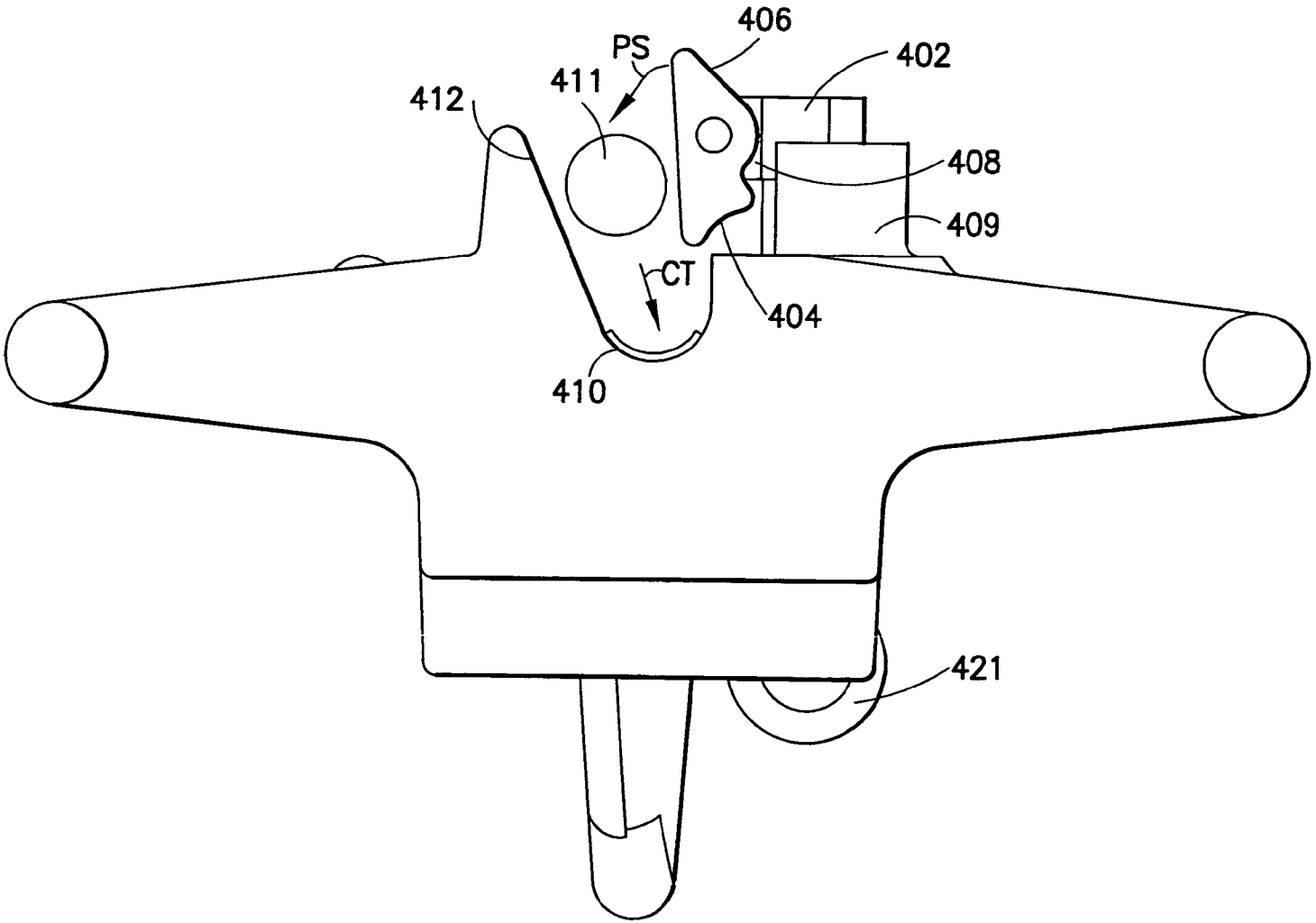
FIG. 25 is a front view of the first connection section shown in FIG. 24 with a pad of the first connection section rotated downward.
Figure 26:
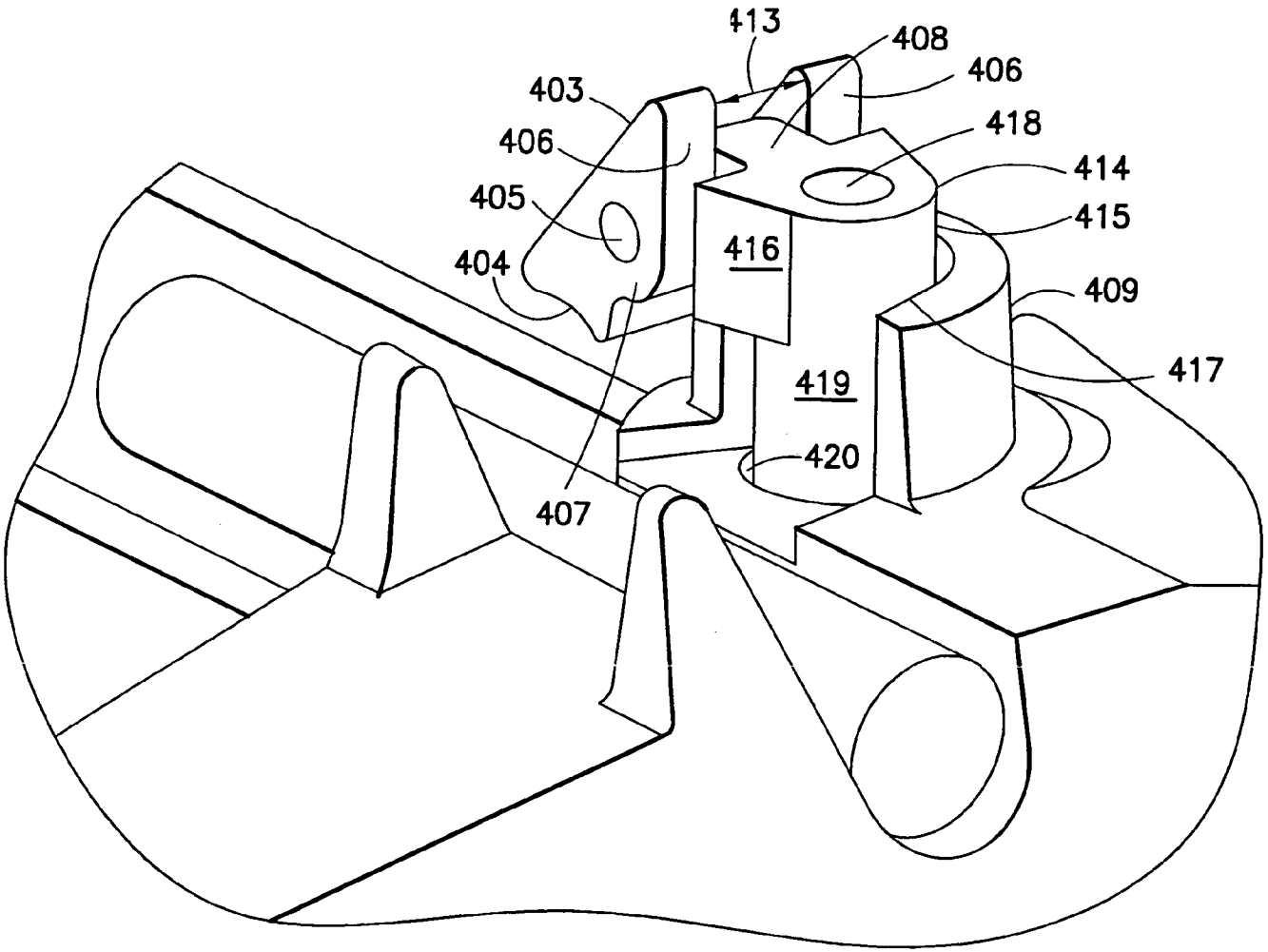
FIG. 26 is a partial perspective view of the first connection section shown in FIG. 24 with the pad of the first connection section rotated in a full open position.
Figure 27:
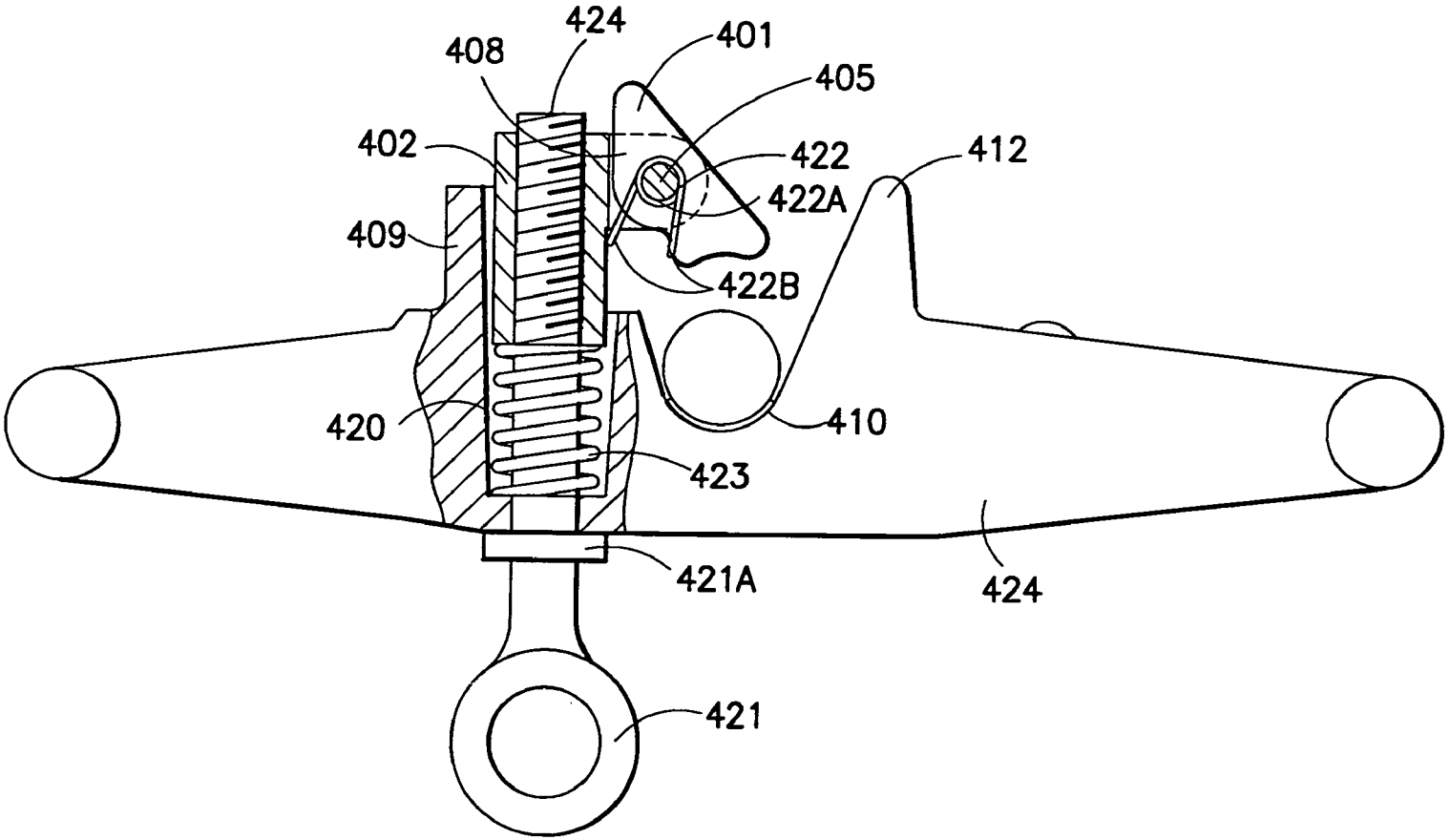
FIG. 27 is a cross section view of the first connection section shown in FIG. 24 taken along a pad rotation axis.

Referring also to FIGS. 24-27, a fourth embodiment of the invention is shown. This design consists of a combination of the first concept (swing a-way pad) and the second concept (rotating pad). FIG. 24 shows the assembly in the upper position. FIG. 25 shows the swivel pad rotated downward allowing the conductor to enter. FIG. 26 shows the assembly in the full open position in 90 degree rotation. FIG. 27 shows a section view of the eyebolt and the pressure pad assembly. The new design consists of a pivot arm 402 and a swivel pad 401. The swivel pad 401 has a pivoting pin 405. The pivoting pin 405 is the axis which enables the swivel pad 401 to rotate. The swivel pad 401 can rotate in a counter and counterclockwise direction (PS) about an axis that is generally perpendicular to the longitudinal axis of the conductor receiving seat (or groove). The surface 406 on the swivel pad 401 limits the rotation travel (PS). The surface 406 makes contact with 406A on the pivot arm 402 to create this action. The radius 407 allows the pad to rotate without interference. The pivot arm 402 has a protruding boss 408 in which the pivot pin 405 is inserted into. The swivel pad 401 has a recess 413. The recess 413 is the area where the boss 408 has to be inserted into. The pivot pin 405 is then inserted thru the swivel pad 401 and into the boss 408 thus allowing the swivel pad 401 and the pivot arm 402 to act as a complete assembly.

In the area where recess 413 is, a torsion spring 422 is inserted. The loop 422A of the torsion spring 422 is where the pivoting pin 405 is inserted into. When the torsion spring 422 is inserted into the assembly, it allows the swivel pad 401 to return to the limit surface area 406 and area 406A. This action is created because one of the legs 422B is in contact with the pivot arm 402 and the other leg 422 is in contact with the swivel pad 401. When the assembly is together and installed into the cavity wall 409, the surface 403 and the surface 412 acts as a guide for the conductor 411. The assembly has a threaded hole 418 in which an eyebolt 421 is inserted into. The eyebolt 421 has a flange 421A that makes a bearing surface against the body 424. The assembly has a spring 423 between the bottom of the pivot arm 402 and the bottom of the cavity 420. The spring 423 allows the assembly to automatically return to the open position. The pivot arm 402 has a limited rotation surface 414 and 416. The surface 414 allows the assembly to rotate 90 degrees only in the clockwise direction and 416 limits the rotation of the assembly in the counterclockwise direction.

The surface 414 makes contact with the surface 415 and limits the rotation in the clockwise direction. The surface 416 makes contact with the surface 417 and limits the rotation in the counterclockwise direction. Because the swivel pad 401 is allowed to rotate downward, this allows the conductor 411 to enter the wire groove 410. When the swivel pad 401 returns to the upper position the conductor 410 is captured in the wire groove.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector subassembly comprising:

a frame member comprising a first leg section and a conductor receiving area connected to the first leg section, wherein the first leg section is configured to be connected to an electrical isolator, wherein a length of the conductor receiving area extends in a first direction, and wherein the conductor receiving area is configured to receive a first electrical conductor in a second direction; and a first pad movably connected to the frame member adjacent to the conductor receiving area, wherein the first pad is configured to contact the first electrical conductor, and wherein the first pad is configured to be movable toward the conductor receiving area and the second direction.

2. The electrical connector subassembly of claim 1 wherein the first direction is substantially perpendicular to the second direction.

3. The electrical connector subassembly of claim 1 further comprising a first spring, wherein the first spring biases the first pad in a first position.

4. The electrical connector subassembly of claim 1 wherein the conductor receiving area comprises a grooved section.

5. The electrical connector subassembly of claim 1 wherein the first direction is substantially perpendicular to the second direction, wherein the electrical connector subassembly further comprises a first spring, and wherein the first spring biases the first pad in a first position.

6. The electrical connector subassembly of claim 5 wherein the conductor receiving area comprises a grooved section.

7. The electrical connector subassembly of claim 6 wherein the first pad is pivotably connected to the frame member.

8. The electrical connector subassembly of claim 1 wherein the first pad is pivotably connected to the frame member.

9. The electrical connector subassembly of claim 1 further comprising a second pad movably connected to the frame member opposite the first pad.

10. The electrical connector subassembly of claim 9 wherein the first pad and the second pad each comprise a tapered surface, and wherein the tapered surfaces form a general "V" shape.

11. The electrical connector subassembly of claim 10 wherein the general "V" shape forms a conductor lead-in surface.

12. The electrical connector subassembly of claim 1 wherein the conductor receiving area forms a first longitudinal axis, wherein the first pad comprises a first end and a second end, wherein the first end is configured to contact the first electrical conductor, and wherein the second end is movably connected to the frame member about a second longitudinal axis, and wherein the second longitudinal axis is substantially parallel to the first longitudinal axis.

13. The electrical connector subassembly of claim 1 further comprising an arm member, wherein the first pad is rotatably attached to the arm member.

14. The electrical connector subassembly of claim 13 wherein the arm member and the first pad are received by a cavity of the frame member.

15. The electrical connector subassembly of claim 13 further comprising a spring between the arm member and the first pad.

16. The electrical connector subassembly of claim 13 wherein the first pad further comprises at least one guide tab, and wherein the guide tab is received by a guide tab slot of the frame member.

17. The electrical connector subassembly of claim 13 further comprising a threaded member, wherein the threaded member extends through the frame member and engages with the arm member.

18. The electrical connector subassembly of claim 13 wherein the conductor receiving area forms a first longitudinal axis, wherein the arm member and the first pad are rotatable about a second axis, and wherein the second axis is substantially perpendicular to the first axis.

19. The electrical connector subassembly of claim 18 wherein the arm member and the first pad are rotatable between first position and second position.

20. The electrical connector subassembly of claim 1 wherein the frame member further comprises at least one conductor guide rail, wherein the at least one conductor guide rail is adjacent to the conductor receiving area, and wherein the at least one conductor guide rail is opposite the first pad.

21. The electrical connector subassembly of claim 20 wherein the first pad comprises a first tapered surface, wherein the at least one conductor guide rail comprises a second tapered surface, and wherein the first tapered surface and the second tapered surface form a conductor lead-in surface.

22. An electrical connector comprising:

a frame comprising a first electrical connector subassembly as in claim 1, a second electrical connector subassembly, and an electrical isolation section between the first electrical connector subassembly and the second electrical connector subassembly.

23. An electrical connector comprising:

a frame comprising a first section, a second section, and an electrical isolation section between the first section and the second section;

wherein the first section comprises a first conductor receiving area and a first pad adjacent to the first conductor receiving area, wherein the conductor receiving area forms a first longitudinal axis, wherein a first end of the first pad is configured to contact a first conductor, wherein a second end of the first pad is rotatably connected to the first section about a pad rotation axis, wherein the pad rotation axis is substantially perpendicular to the first longitudinal axis, and wherein the first pad is configured to be rotatable between a first position and a second position; and wherein the second section comprises a second conductor receiving area.

24. The electrical connector of claim 23 wherein the first pad is configured to be rotatable between a first stop surface and a second stop surface of the first section.

25. The electrical connector of claim 23 further comprising a boss member connected to the first section, wherein the boss member comprises a cavity, and wherein the second end of the first pad is received by the cavity.

26. The electrical connector of claim 23 further comprising an arm member, wherein the first pad is rotatably attached to the arm member.

27. The electrical connector of claim 26 wherein the first pad is rotatable toward the first longitudinal axis of the conductor receiving area.

28. The electrical connector of claim 26 wherein the arm member and the first pad are received by a cavity of the first section.

29. The electrical connector of claim 26 further comprising a spring between the arm member and the first pad.

30. The electrical connector of claim 26 further comprising a threaded member, wherein the threaded member extends through the first section and engages with the arm member.

31. The electrical connector of claim 23 wherein the first section further comprises at least one conductor guide rail, wherein the at least one conductor guide rail is adjacent to the conductor receiving area, and wherein the at least one conductor guide rail is opposite the first pad.

32. The electrical connector of claim 31 wherein the first pad comprises a first tapered surface, wherein the at least one conductor guide rail comprises a second tapered surface, and wherein the first tapered surface and the second tapered surface form a conductor lead-in surface.

33. A method of assembling a conductor connector frame member assembly comprising:

providing a conductor connector frame member comprising a first leg section and a conductor receiving area connected to the first leg section, wherein the first leg section is configured to be connected to an electrical isolator, wherein a length of the conductor receiving area extends in a first direction, and wherein the conductor receiving area is configured to receive a first electrical conductor in a second direction; and connecting a first pad to the conductor connector frame member, wherein the first pad is configured to contact the first electrical conductor, and wherein the first pad is configured to be movable toward the conductor receiving area and the second direction.

34. A method of assembling a conductor connector comprising:

providing a frame having a first section, a second section, and an electrical isolation section, wherein the first section comprises a first conductor receiving area, wherein the first conductor receiving area forms a first longitudinal axis, wherein the second section comprises a second conductor receiving area, and wherein the electrical isolation section is between the first and second sections; and connecting a first pad to the first connection section, wherein a first end of the first pad is configured to contact the first conductor, wherein a second end of the first pad is rotatably connected to the first section about a pad rotation axis, and wherein the pad rotation axis is substantially perpendicular to the first longitudinal axis.

* * * * *